US005486903A

United States Patent [19]

Kanno et al.

[11] Patent Number: 5,486,903

[45] Date of Patent: Jan. 23, 1996

[54] IMAGE FORMING APPARATUS WITH PAPER THICKNESS DETECTOR

[75] Inventors: Satoru Kanno, Yokohama; Toru Katsumi, Kawasaki; Ikuo Takeuchi, Tokyo, all of Japan

[73] Assignee: Canon Kabushiki Kaisha, Tokyo, Japan

[21] Appl. No.: 271,679

[22] Filed: Jul. 7, 1994

[30] Foreign Application Priority Data

Jul. 16, 1993 [JP] Japan ..... 5-176494

[51] Int. Cl.[6] ..... G03G 21/00

[52] U.S. Cl. ..... 355/208; 355/246; 355/285; 355/311

[58] Field of Search ..... 355/203, 204, 355/208, 282, 285, 290, 246, 311; 118/60; 219/216, 469, 470; 432/60

[56] References Cited

U.S. PATENT DOCUMENTS

| | | | |
|---|---|---|---|
| 4,549,803 | 10/1985 | Ohno et al. | 219/216 X |
| 4,610,530 | 9/1986 | Lehmbeck et al. | 355/311 |
| 4,634,262 | 1/1987 | Imaizumi et al. | 355/311 |
| 4,873,553 | 10/1989 | Inaba | 355/282 X |
| 5,351,114 | 9/1994 | Matsuno | 355/285 |

FOREIGN PATENT DOCUMENTS

| | | |
|---|---|---|
| 63-313182 | 12/1988 | Japan . |
| 64-88571 | 4/1989 | Japan . |
| 3-208077 | 9/1991 | Japan . |
| 4-134459 | 5/1992 | Japan . |

*Primary Examiner*—William J. Royer
*Attorney, Agent, or Firm*—Fitzpatrick, Cella, Harper & Scinto

[57] ABSTRACT

The present invention has a detection device for detecting the thickness of a recording material by using an air capacitor, and an image forming device for forming an image on the recording material on the basis of the output from the detection device. The present invention can thus prevent omission in transfer and fixing failure, thereby forming a good image.

6 Claims, 14 Drawing Sheets

IMAGE FORMING APPARATUS WITH PAPER THICKNESS DETECTOR

BACKGROUND OF THE INVENTION

Field of the Invention

The present invention relates to an image forming apparatus such as a copying apparatus, a laser beam printer and the like, which forms an image on a recording material.

Description of the Related Art

In a conventional image forming apparatus, a developer bearing member is adjacent to an electrostatic latent image formed on an image holding member, and the electrostatic latent image is developed by applying a bias to the developer bearing member to form a toner image which is then transferred onto a recording material by transfer means and fixed to the recording material by fixing means.

However, the conventional apparatus has the problem that if the thickness of the recording material is changed, e.g., it is increased, an omission may occur in transfer due to insufficient transfer charge or in fixing due to a decrease in the temperature of fixing means caused by the absorption of heat by the recording material.

An image forming apparatus provided with a fixing device which employs a heating member having a low heat capacity, as disclosed in Japanese Patent Laid-Open No. 63-13182, has recently been popularized. The temperature and driving speed of the heating member of such a fixing device are controlled to be kept constant.

The temperature of the heating member is set on the basis of paper having a thickness of 80 μm (500 sheets, 4 cm thick), which is the most frequently used paper.

However, in the fixing device utilizing the heating member having a low heat capacity, the recording paper which passes therethrough even more easily absorbs heat, and thus the heating member temperature decrease that occurs if the thickness of the recording material is large.

When a decrease in the temperature of the heating member is detected by temperature detection means, control is made for increasing power supply to the heating member to increase the temperature thereof to a previously set temperature. However, in the case of thick recording materials, the temperature decrease of the heating member is significant, and thus, control for increasing the power supply does not sufficiently compensate for the decrease in the temperature, thereby causing fixing failures.

SUMMARY OF THE INVENTION

An object of the present invention is to provide an image forming apparatus which can prevent omission in transfer or a fixing failure even if the thickness of a recording material changes.

Another object of the present invention is to provide an image forming apparatus comprising an air capacitor for detecting the thickness of a recording material and an image forming means which is controlled on the basis of the result of detection of the thickness of the recording material.

A further object of the present invention is to provide an image forming apparatus comprising fixing means with a film which is controlled on the basis of the result of detection of the thickness of a recording material.

In accordance with these objects, there is provided an image forming apparatus with an image forming means for forming an image on a recording material, detection means for detecting the thickness of the recording material, the detecting means having an air capacitor comprising two opposing conductor plates spaced at a predetermined distance for detecting the thickness of the recording material by measuring a change in electrostatic capacity when the recording material is inserted between the conductor plates of the air capacitor, and control means for controlling the image forming means on the basis of an output of the detection means.

In accordance with yet another aspect of the invention, there is provided an image forming apparatus comprising image forming means for forming an unfixed image on the recording material, fixing means for fixing the unfixed image on the recording material, the fixing means including a heater, a film adjacent the heater and a pressure roller in pressure contact with the film at a pressure contact portion so as to hold and convey the recording material at the pressure contact portion to heat and fix the unfixed image, detection means for detecting the thickness of the recording material and control means for controlling the fixing means on the basis of an output from the detection means.

Other objects of the present invention will be made clear from the description below.

DETAILED DESCRIPTION OF THE PREFERRED EMBODIMENTS

Embodiments of the present invention are described below with reference to the drawings.

The schematic construction of an image forming apparatus in accordance with the present invention is first described with reference to FIG. 1.

Figure 1:
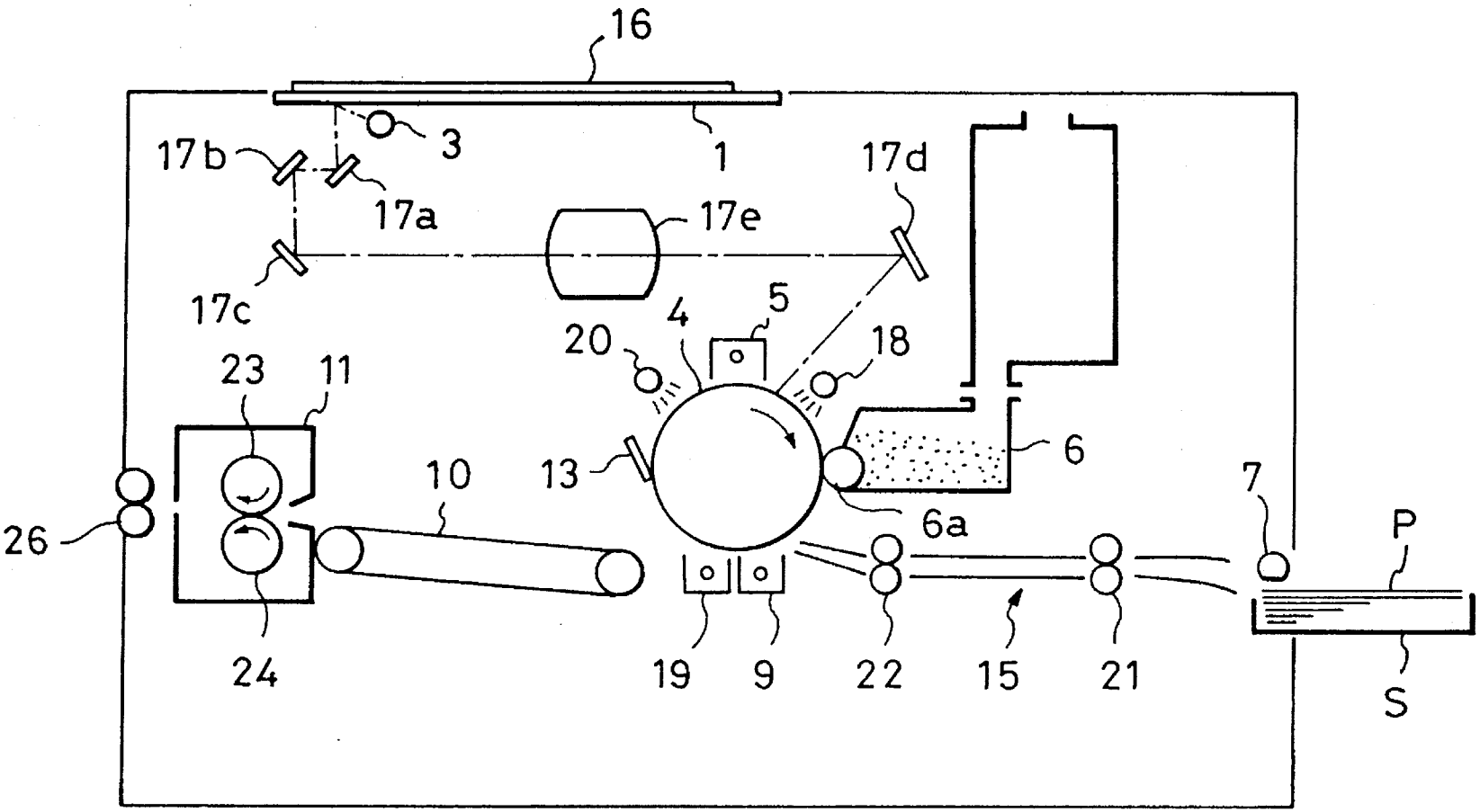
FIG. 1 is a sectional view illustrating the schematic construction of an image forming apparatus in accordance with the present invention.

In FIG. 1, reference numeral 1 denotes an original plate glass for mounting an original 16 thereon, and reference numeral 3 denotes an exposure lamp for illuminating the original 16. Reference numerals 17*a*, 17*b*, 17*c* and 17*d* each denote a reflecting mirror for changing the optical path of the light reflected from the original 16; and reference numeral 17*e* denotes a lens having the focusing function and the enlarge/reduction function.

Reference numeral 4 denotes a photosensitive drum, serving as an image holding member, which is rotated in the arrow direction shown in FIG. 1; reference numeral 5, a charger; reference numeral 18, a destaticizing lamp for destaticizing a non-image region of the photosensitive drum 4; reference numeral 6, a developing unit; reference numeral 6*a*, a developer bearing member; reference numeral 9, transfer charger; reference numeral 19, a separation charger; reference numeral 13, a cleaner; and reference numeral 20, a destaticizing lamp. Reference character S denotes a cassette for containing recording materials P, reference numeral 7 denotes a feed roller, and reference numerals 21 and 22 each denote a pair of conveyance rollers.

Reference numeral 15 denotes a location for a paper thickness detector for detecting the thickness of the recording material P; reference numeral 10, a conveyance belt for conveying the recording material P on which an image is recorded to the fixing side; and reference numeral 11, a fixing device for thermally fixing a developer image on the conveyed recording material P.

The photosensitive drum 4 has a surface comprising a seamless photosensitive material made of a photoconductor, and is rotatably axially supported so as to rotate in the direction of the arrow shown in the drawing in response to an ON operation of a copy start key.

The original 16 placed on the original plate glass 1 is illuminated with the exposure lamp 3 which is integrated with the reflecting mirror 17*a*. The light reflected from the original 16 is reflected off the mirrors 17*a*, 17*b* and 17*c*, passes through the lens 17*e*, and is reflected off the mirror 17*d* to form an image on the photosensitive drum 4.

The photosensitive drum 4 is subjected to uniform corona charge by the charger 5 so that when the original image is slit-exposed to the surface of the photosensitive drum 4 by the exposure lamp 3, an electrostatic latent image is formed on the photosensitive drum 4 by the known Carlson process. The electrostatic latent image on the photosensitive drum 4 is developed by the development device 6 to be visualized as a toner image.

The recording material P in the cassette is sent into the body of the apparatus by the feed roller 7, and the leading end of the recording material P is aligned with the leading end of the toner image on the photosensitive drum 4. The toner image is transferred to the recording material P by the transfer charger 9. The recording material P to which the toner is transferred is separated from the photosensitive drum 4 by the separation charger 19, and then conveyed to the fixing device 11 by the conveyance belt 10. The recording material P is passed between a fixing roller 23 and a pressure roller 24 of the fixing device 11 to fix the toner image thereto and finally discharged to the outside of the apparatus body by discharge rollers 26.

After completion of transfer, the photosensitive drum 4 is continuously rotated so that the surface thereof is cleaned by the cleaner 13 and the residual charge removed by the destaticizing lamp 20.

Figure 2:
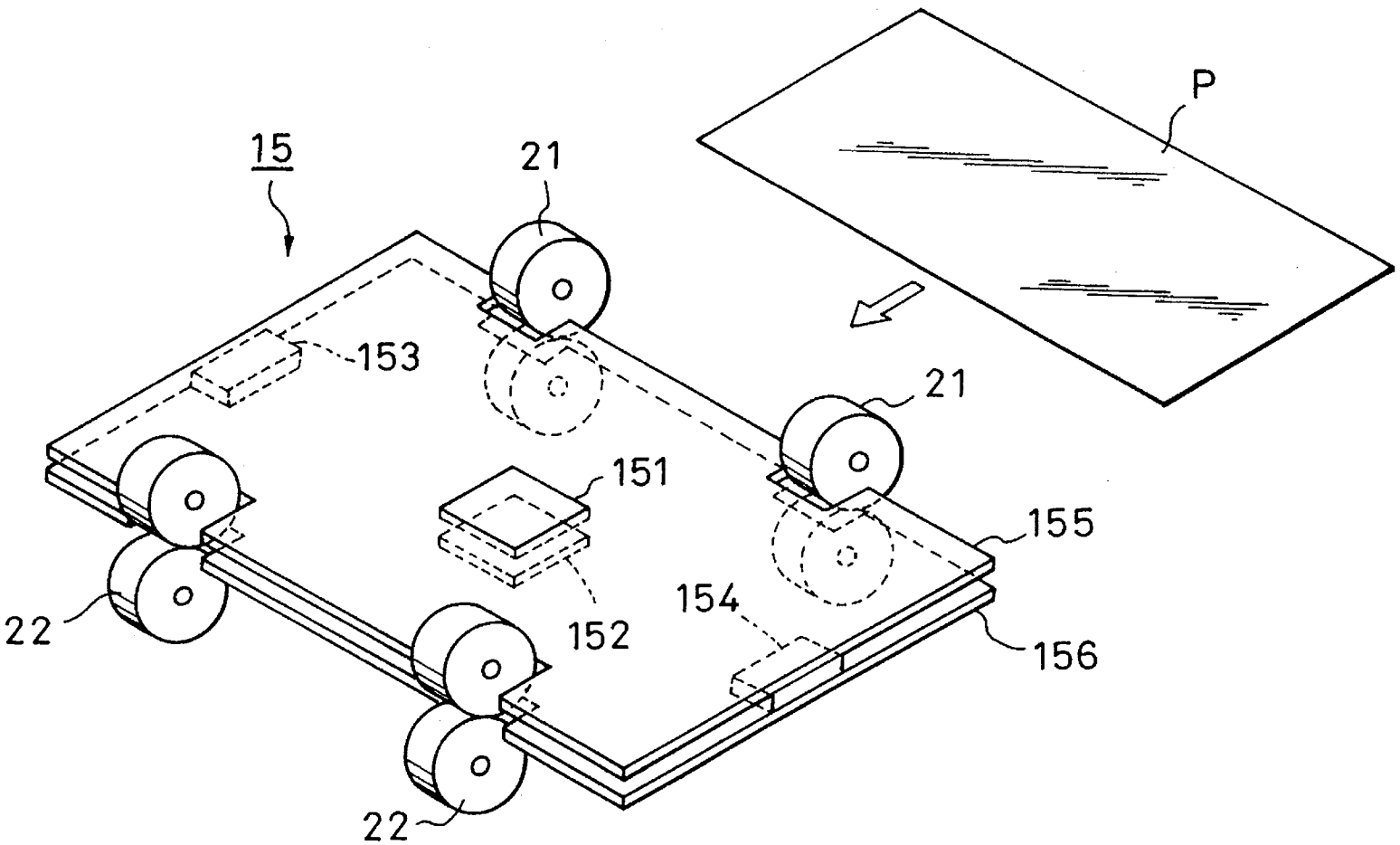
FIG. 2 is a perspective view illustrating a paper thickness detector.

Description will now be made of the paper thickness detector 15 with reference to FIGS. 2 and 3. FIG. 2 is a perspective view of the paper thickness detector 15, and FIG. 3 is a drawing illustrating the construction of paper thickness detection means comprising the paper thickness detector 15.

Figure 3:
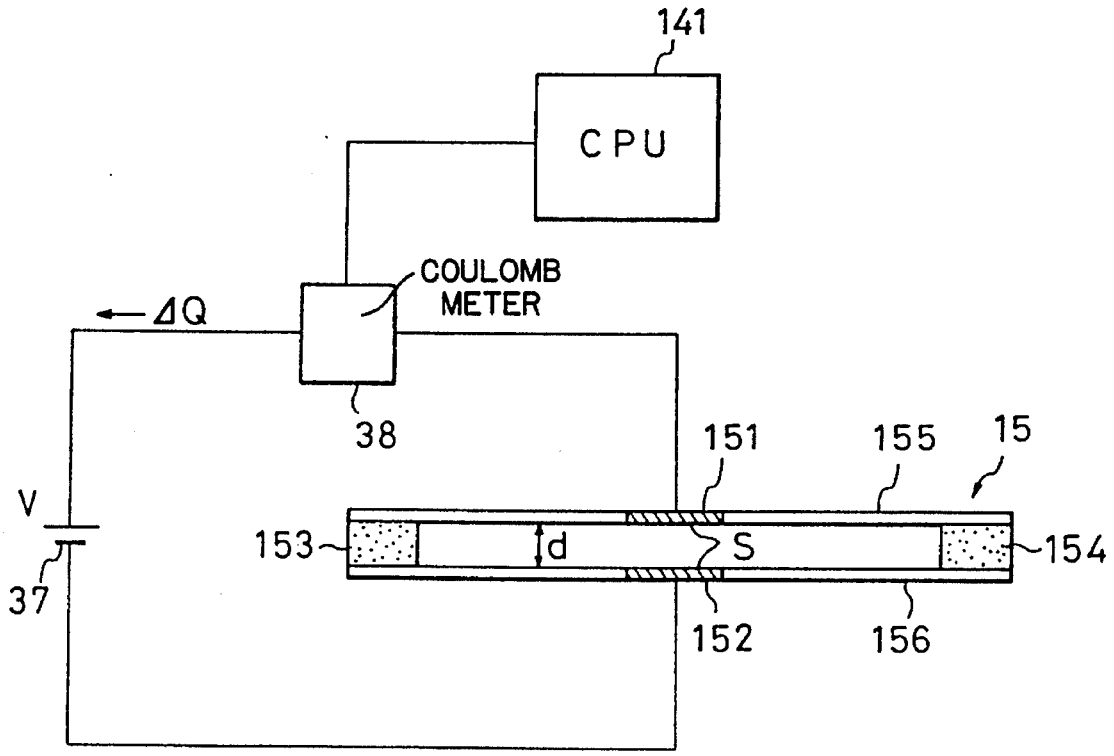
FIG. 3 is a drawing illustrating the construction of paper thickness detection means including a paper thickness detector.

The paper thickness detector 15 comprises an air capacitor having upper and lower conductor plates 151 and 152 which are opposite to each other at a predetermined distance d therebetween, as shown in FIG. 3. The conductor plates 151 and 152 are supported by conveyance guide plates 155 and 156 made of an insulating material, and the distance d between both plates is kept at d=0.5 mm by spacers 153 and 154. The area of each of the conductor plates 151 and 152 is set to S=20 mm ×20 mm.

The recording material P is conveyed by the conveyance roller pairs 21 and 22 so as to be passed between the conductor plates 151 and 152. The thickness of the recording material P is determined by a change in the electrostatic capacity of the air capacitor during passage of the recording material P between the conductor plates 151 and 152.

Namely, a voltage V=5 volt is constantly applied between the conductor plates 151 and 152 by a constant-voltage power supply 37, and when no recording material P is present between the conductor plates 151 and 152, the following equations hold:

$$Q_0=C_0 \cdot V \tag{1}$$

$$Q_0=\epsilon_0 \cdot S/D \tag{2}$$

wherein $Q_0$ is the charge amount stored between the conductor plates 151 and 152

$C_0$ is the electrostatic capacity of the air capacitor $\epsilon_0$ is the dielectric constant of air ($=8.85\times10^{-12}$ F/m)

When the recording material P is inserted between the conductor plates 151 and 152, the charge amount Q stored between the conductor plates 151 and 152, and the electrostatic capacity C of the air capacitor are represented by the following equations:

$$Q=C \cdot V \tag{3}$$

$$C=S/\{(t/\epsilon)+(d-t)/\epsilon_0\} \tag{4}$$

wherein t is the thickness of the recording material P $\epsilon$ is the dielectric constant of the recording material P {indicating a substantially constant value ($=2.6\times10^{-11}$ F/m) regardless of the thickness of the recording material P}

From the above equations (1) to (4), the thickness t of the recording material P is determined by the following equation:

$$t = \frac{d/\epsilon_0}{(S \cdot V/d \cdot \Delta Q) \cdot (1 - \epsilon_0/\epsilon) + (1/\epsilon_0 - 1/\epsilon)} \quad (5)$$

wherein $\Delta Q = Q - Q_0$

The measurement of the amount of the charge $\Delta_Q$ which flows from the conductor plates 151 and 152 permits the thickness t of the recording material P to be determined by the above equation (5). The charge $\Delta_Q$ is detected by a Coulomb meter 38, and the detected signal is transmitted to a CPU 141, which will be described below, and is used for computing the thickness t of the recording material P in the CPU 141.

Figure 4:
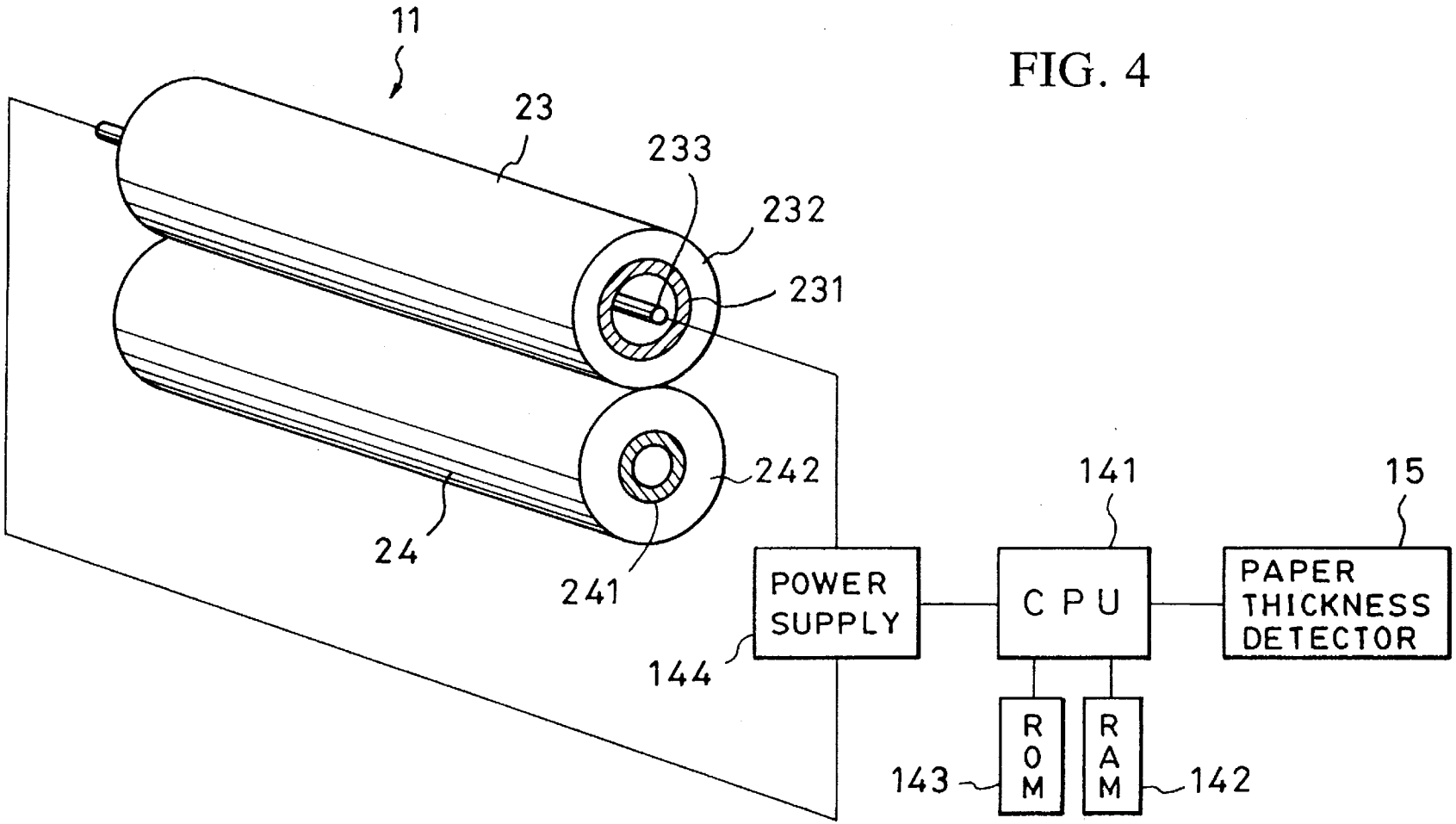
FIG. 4 is a drawing illustrating the construction of control means provided in an image forming apparatus in accordance with an embodiment of the present invention.
Figure 5:
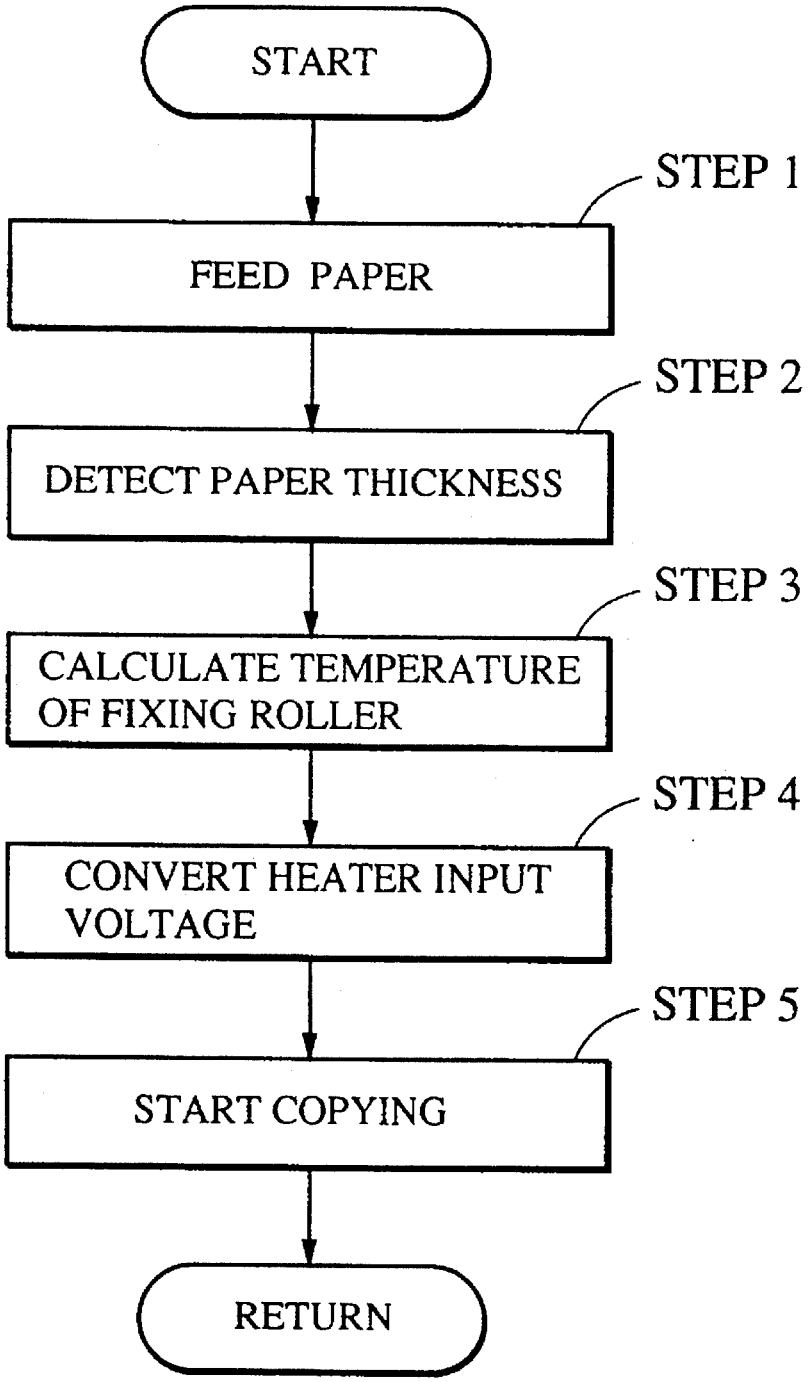
FIG. 5 is a flowchart illustrating the control operation of control means provided in an image forming apparatus in accordance with an embodiment of the present invention.

The control operation in the image forming apparatus is described below with reference to FIGS. 4 and 5. FIG. 4 is a drawing illustrating the construction of fixing device 11 and its control means, and FIG. 5 is a flowchart illustrating the procedure of the control operation.

In this embodiment, the heating temperature of the fixing device 11 is controlled in accordance with the thickness t of the recording material P which is detected by the paper thickness detector 15.

As described above, the fixing device 11 comprises the fixing roller 23 and the pressure roller 24 which are in pressure contact and which are rotatably axially supported. The fixing roller 23 comprises a cylindrical core 231 and a coating layer 232 formed on the core 231. Coating layer 232 consists of a fluororesin or the like and has good release properties. The fixing roller 23 has a heater 233 at its center so as to heat the surface of the fixing roller 23 from the inside.

The pressure roller 24 comprises a cylindrical core 241, and a silicon rubber layer 242 formed on the core 241 and having high elasticity. The pressure roller 24 is brought into pressure contact with the fixing roller to form a fixing nip portion therebetween.

When the recording material P passes through the fixing nip portion in such a manner that the side of the recording material P bearing the toner image contacts the fixing roller 23, the toner is melted, and the toner image is fixed to the recording material P. At this time, it is necessary for sufficient fixing to supply an adequate amount of heat to the toner.

However, since heat is absorbed by not only toner but also the recording material, the use of thick paper having a high heat capacity as the recording material P increases the amount of the heat absorbed by the recording material P and thus inhibits the supply of adequate heat to the toner, thereby causing incomplete melting of the toner and fixing failure.

It is thus necessary for satisfactorily fixing the image to the thick recording material P to increase the temperature of the fixing roller and supply a great deal of heat.

Figure 6:
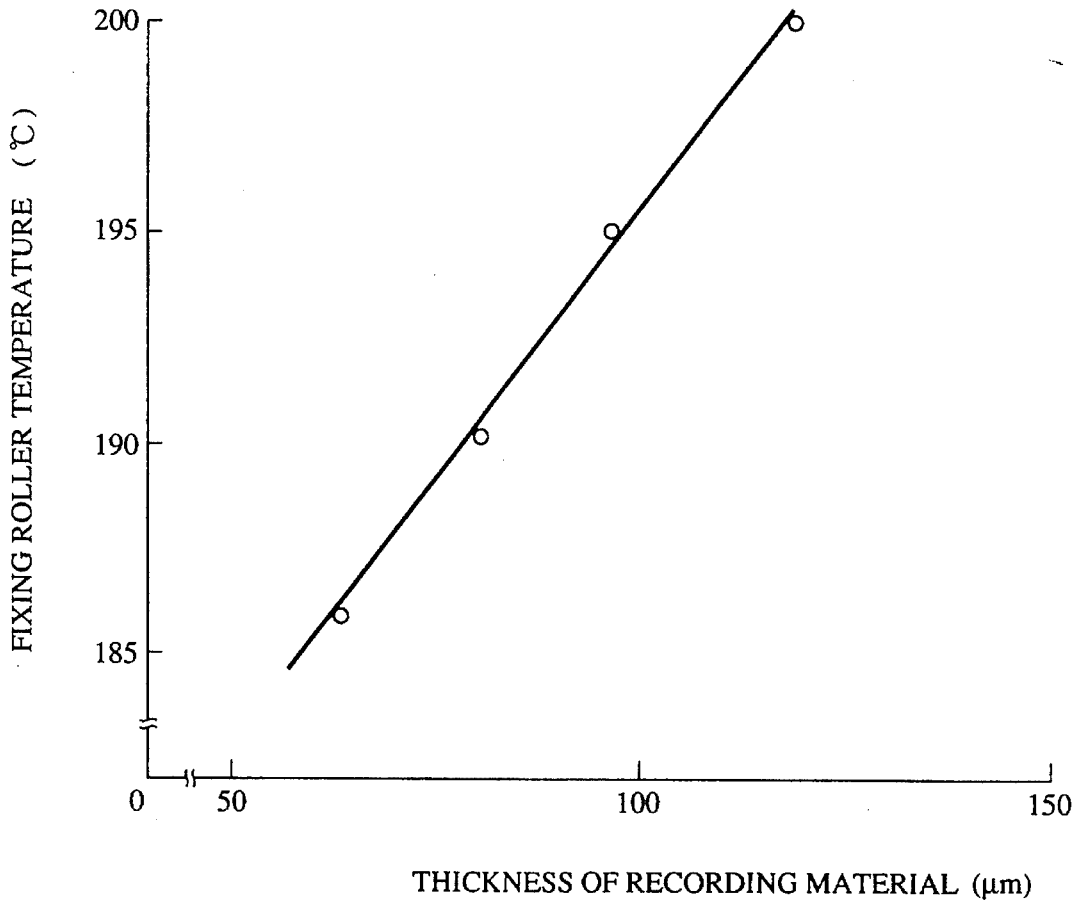
FIG. 6 is a graph illustrating the relation between the thickness of a recording material and an optimum fixing temperature.

However, if the temperature of the fixing roller is at a high level, although fixing can be made for all kinds of paper, excess heat is supplied to thin paper, and thus the electric power is wasted. In consideration of these points, the optimum temperature of the fixing roller for a given thickness of recording material was experimentally determined. The results obtained are shown in FIG. 6. The data shown in FIG. 6 is used for controlling the temperature of the fixing roller.

In FIG. 4, a ROM 143 is memory for storing the data shown in FIG. 6, and the CPU 141 is a controller for computing the optimum temperature of the fixing roller on the basis of the detected signal (indicating information about thick paper) output from the paper thickness detector 15 and the data stored in the ROM 143, and outputting the computed signal to the power supply 144 of the heater 233. The power supply 144 generates a voltage necessary for obtaining the temperature of the fixing roller which is computed by the CPU 141, and applies the voltage to the heater 233. The RAM 142 is memory used for arithmetic processing by CPU 141.

The control flow is described below with reference to FIG. 5. The recording material P contained in the cassette S is first supplied (STEP 1), and the thickness of the recording material P is detected by the aforementioned detection method (STEP 2).

The optimum temperature of the fixing roller is computed from the detected thickness of the recording material P and the data stored in ROM (STEP 3), and the input voltage to the heater 233 is changed in accordance with the computed temperature of the fixing roller (STEP 4) to set the temperature of the fixing roller to a desired value. In setting of the temperature of the fixing roller, the temperature of the fixing roller is detected by a thermistor or the like, and the detected temperature is controlled to be a desired value. The normal copy operation is then started (STEP 5) to form a copy image.

In this embodiment, since the toner image is fixed at an optimum fixing temperature in accordance with the thickness of the recording material used, a good image can uniformly be obtained without fixing failure.

Another embodiment of the present invention is described below with reference to FIGS. 7 and 8. Since the construction of the apparatus is the same as that shown in FIG. 1, different portions alone are described.

Although the above embodiment is of the control of the fixing process in accordance with the thickness of the recording material, the same control can also be applied to the image forming process.

The processes in which an image is affected by the thickness of the recording material used also include the transfer process. In the transfer process, the recording material conveyed is brought into contact with the photosensitive drum, and a charge with the polarity opposite to that of the toner is applied to the back side of the recording material by the transfer charger so that the toner is attracted by the charge to transfer the image. In this transfer process, since the greater the thickness of the recording material,, the smaller the electric force to attract the toner to the recording material becomes, the toner may not be sufficiently transferred to thicker recording materials, thereby easily causing omission in transfer.

When thick paper is used as the recording material, it is necessary to increase the effective electric force by increasing the charge amount per unit area applied to the rear side of the recording material. The charge amount per unit area may be increased by decreasing the conveyance speed of the recording material.

Figure 7:
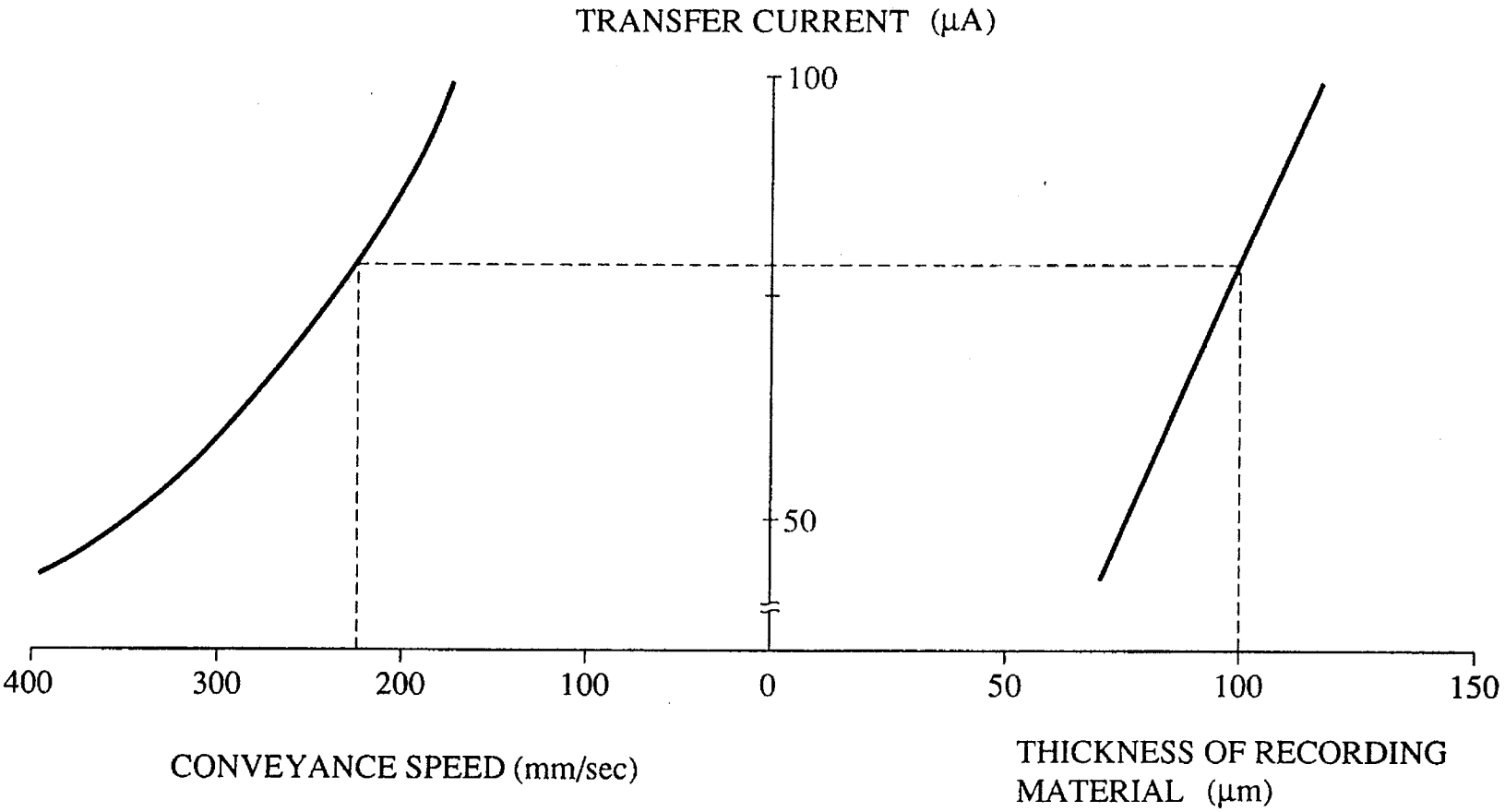
FIG. 7 is a graph illustrating relations of the recording material thickness and the conveying speed to the transfer current.

FIG. 7 shows the results of an experiment in which the conveyance speed of the recording material required for satisfactorily transferring an image was determined by changing the thickness of the recording material.

In FIG. 7, a relation between the thickness (μm) of the recording material and the current required for transfer (current flowing to the unit area of the recording material) (μA) is shown in the right quadrant, and a relation between the conveyance speed (mm/sec) and the current (μA) is shown in the left quadrant. As seen from FIG. 7, the current increases as the conveyance speed decreases, and both have an inversely proportional relation. For example, the conveyance speed optimum for the recording material having a thickness of 100 μm is 224 mm/sec.

Figure 8:
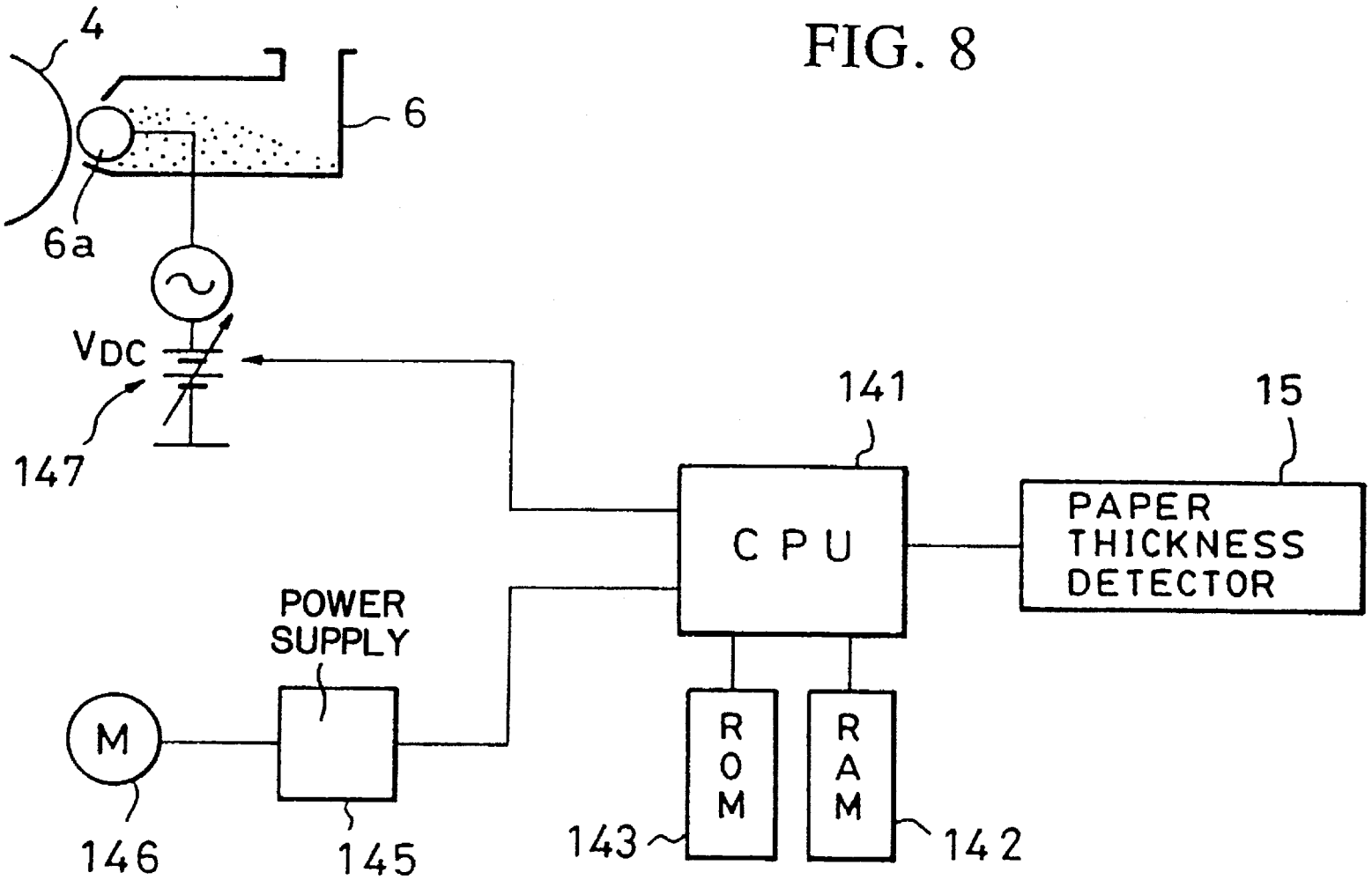
FIG. 8 is a drawing illustrating the configuration of control means provided in an image forming apparatus in accordance with another embodiment of the present invention.

FIG. 8 is a block diagram of a control circuit for control of conveyance speed in accordance with recording material thickness. In this drawing, the same portions as those shown in FIG. 4 which relates to the above embodiment are denoted by the same reference numerals.

The ROM 143 stores the data shown in FIG. 7, and the CPU 141 computes the optimum conveyance speed from the thickness of the recording material which is detected by the paper thickness detector 15 and the data stored in ROM 143, and transmits the computed conveyance speed to the driving power supply 145 of the motor 146. The driving power supply 145 generates the driving voltage required for obtaining the calculated conveyance speed to rotate the motor 146 at a desired speed. This can achieve the optimum conveyance speed of the recording material and good transfer.

Since the quantity of heat supplied to the toner image on the recording material in the fixing process is increased by decreasing the conveyance speed, fixing of images on thick recording materials can be satisfactorily performed by decreasing the conveyance speed. Thus, in a modification of the first embodiment, the conveyance speed may be changed in place of changing the fixing temperature in accordance with the thickness of the recording material.

Still another embodiment of the present invention is described below. Since the construction of the apparatus is the same as that shown in FIG. 1, only the different portions are described below.

This embodiment relates to another method of optimum image transfer in accordance with the thickness of the recording material.

As described above, if thick paper is used as the recording material, the transfer electric force is decreased, thereby causing possible omissions in transfer.

The amount of the toner transferred may be increased by increasing the amount of the toner which forms the toner image on the photosensitive member, thereby preventing omission in transfer. Namely, even if the electric force is small, the number of the toner particles which contribute to transfer may be increased, and thus the toner image density may be increased. The toner image density can be increased by decreasing the bias $V_{DC}$ applied to the developer bearing member.

Figure 9:
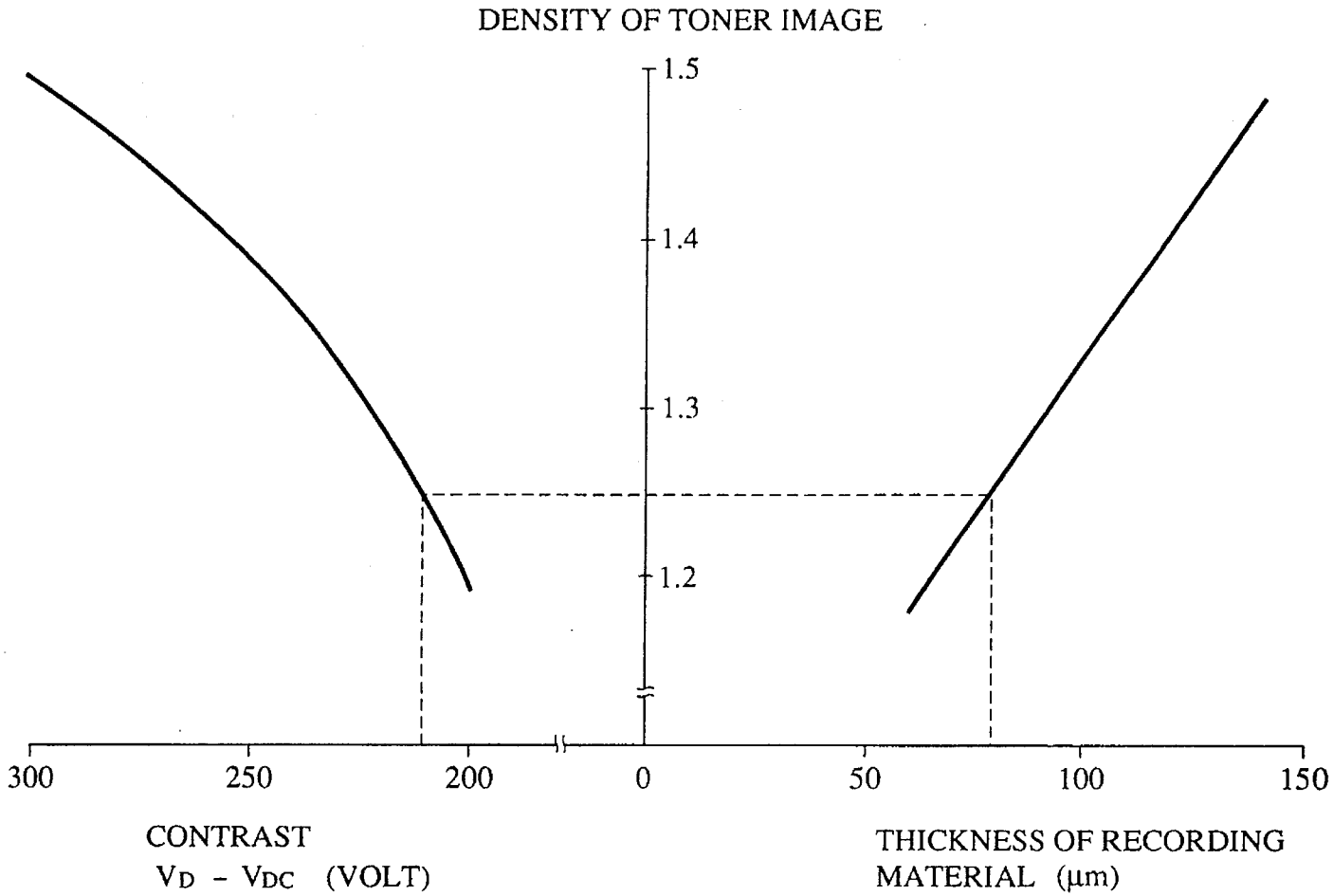
FIG. 9 is a drawing illustrating relations of the recording material thickness and contrast to the toner image density.

The contrast (difference between the potential of the black portion $V_D$ and the bias $V_{DC}$) required for good transfer was experimentally determined by changing the thickness of the recording material. The results are shown in FIG. 9. In FIG. 9, the relation between the thickness (μm) of the recording material and the toner image density required for good transfer is shown in the right quadrant, and the relation between the contrast ($V_D$ - $V_{DC}$) (Volt) and the toner image density is shown in the left quadrant.

The data shown in FIG. 9 is stored in the ROM 143 and is used for computing the optimum bias. Referring to FIG. 9, for example, the optimum image contrast for the recording material having a thickness of 80 μm is obtained at 225 volt. In this embodiment, the potential of the black portion is fixed at $V_D$=400 volt, and the bias is $V_{DC}$=175 volt.

FIG. 8 illustrates a portion of the control circuit.

The optimum bias $V_{DC}$ is determined on the basis of the paper thickness signal, and the bias power supply 147 is set to a desired value to supply the optimum bias $V_{DC}$ to the developer bearing member 6*a*. As a result, the density of the toner image to be developed is adjusted, and a transfer image with a sufficient density can thus be obtained.

Although, in this embodiment, the bias $V_{DC}$ is changed for changing the contrast, the potential $V_D$ of the black background may be changed, and the output of the charger or the quantity of light of the exposure lamp may be changed for changing the potential $V_D$.

In the above-described embodiment, the heating temperature of the fixing means, the bias applied to the developer bearing member or the conveyance speed of the recording material is controlled in accordance with the thickness of the recording material which is detected by the paper thickness detector. There is thus the effect of stably obtaining a good image without omission in transfer or fixing failure, regardless of the thickness of the recording material used.

Figure 10:
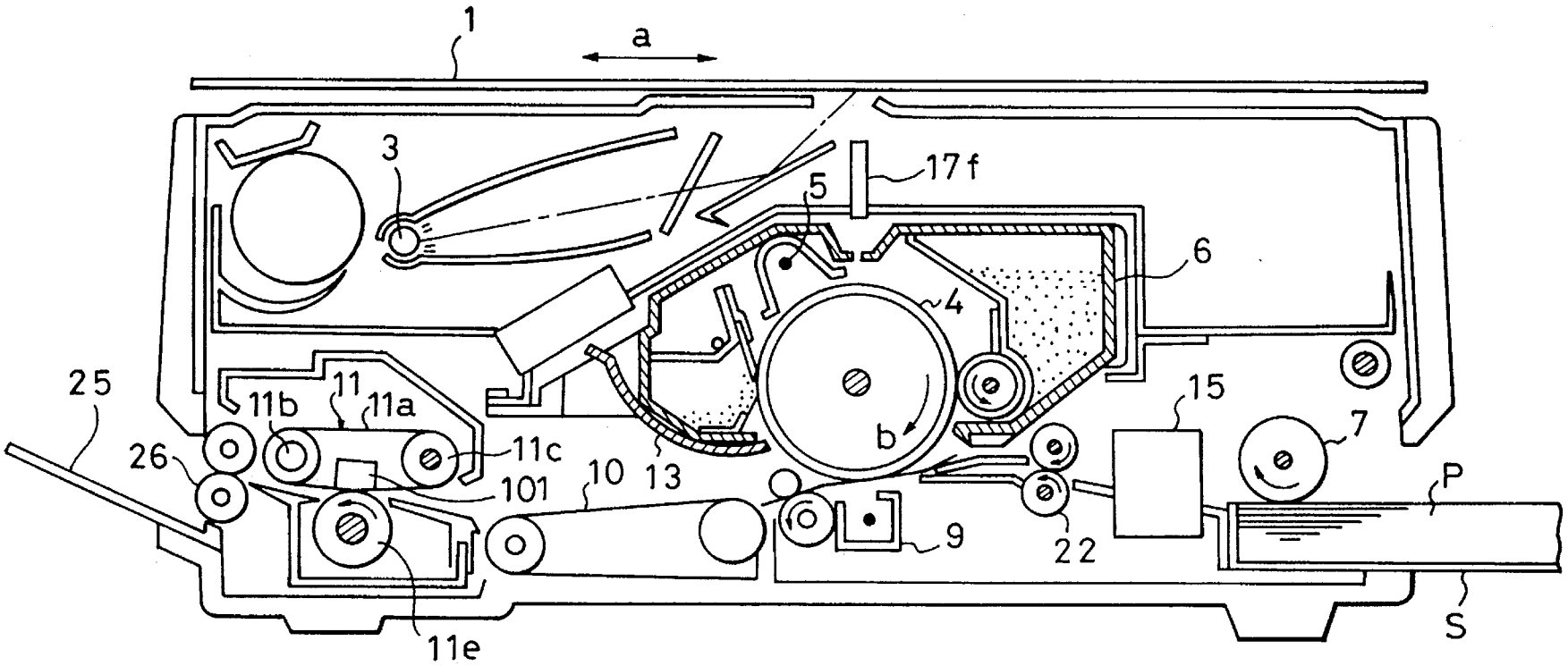
FIG. 10 is a sectional view illustrating the schematic construction of an image forming apparatus in accordance with still another embodiment of the present invention.

FIG. 10 is a sectional view schematically illustrating the construction of an image forming apparatus in accordance with still another embodiment of the present invention. In FIG. 10, the members having the same functions as those of the apparatus shown in FIG. 1 are denoted by the same reference numerals.

In FIG. 10, reference numeral 1 denotes an original placing plate comprising a transparent member made of glass or the like, the original plate 1 being reciprocated in the direction of the arrow shown in FIG. 10 to scan the original. An optical system comprising a short-focal length and small-diameter image forming element array 17*f*, the exposure lamp 3, etc. is disposed under the original mounting plate 1.

The photosensitive drum 4 serving as an image bearing member, and rotating in the direction of the arrow b shown in FIG. 10, is disposed at the substantially central portion in the body of the image forming apparatus. The charger 5, the developing device 6 and the cleaner 13 are disposed around the photosensitive drum 4.

Further, the cassette S for containing recording materials P, the conveyance roller 7, the paper thickness detector 15 for detecting the thickness of the recording material P, the conveyance rollers 22, the transfer charger 9, the conveyance guide 10, the fixing device 11 and the delivered paper tray 25 are disposed along the conveyance direction (from the right to the left of FIG. 10) of the recording material P under the photosensitive drum 4 in the body of the image forming apparatus.

The fixing device 11 has an endless film 11*a*, a driving roller 11*b* for driving the film 11*a*, a driven roller 11*c* for applying tension to the film 11*a*, a low-heat capacity heating member 101 and a pressure roller 11*e*. The heating member 101 is disposed inside of the film 11*a* which is placed on the driving roller 11*b* and the driven roller 11*c* and which slides on the film 11*a*. The pressure roller 11*e* is in pressure contact with the film 11*a* to form a nip between the heating member 101 and the pressure roller 11*e* with the film 11*a* therebetween. Namely, the recording material which holds an unfixed image is held and conveyed by the nip in the pressure-contact portion between the film 11*a* and the pressure roller 11*e* to heat and fix the unfixed image by the heat of the heating member 101. Since the heating member generates heat by electrical charge, the temperature of the heating member 101 is adjusted by controlling the electrical charge time.

The original image placed on the original mounting plate 1 is illuminated with the exposure lamp 3, and the reflected light image is slit-exposed on the photosensitive drum 4 by the array 17*f*.

The photosensitive drum 4 is uniformly charged by the charger 5 so that when the image is exposed on the photosensitive drum 4 by the element array 17*f*, an electrostatic latent image corresponding to the original image is formed on the photosensitive drum 4. The electrostatic latent image is developed by the developing device 6 to form a toner image.

Elsewhere, the recording material P contained in the cassette S is conveyed by the conveyance rollers 22 to the transfer nip portion between the photosensitive drum 4 and the transfer charger 9 at a timing which causes the conveyance roller 7 to synchronize with the toner image on the photosensitive drum 4 to transfer the toner image held on the photosensitive drum 4 by the operation of the transfer charger 9.

The recording material P to which the toner image is transferred as described above is separated from the photosensitive drum 4 by any known separation means, and then guided to the fixing device 11 along the conveyance guide 10. The toner image is then heated and fixed by the fixing device 11, and the recording material P is delivered to the delivered paper tray 25. After the toner image is completely transferred, the toner remaining on the photosensitive drum 4 is removed by the cleaner 13.

In this embodiment, the thickness of the recording material P delivered from the cassette S by the conveyance roller 7 is detected at the time of passage through the paper thickness detector 15. The same paper thickness detector as that shown in FIGS. 2 and 3 is used.

In this embodiment, the driving speed of the fixing device 11 is controlled in accordance with the thickness of the recording material P which is detected by the paper thickness detector 15.

Figure 11:
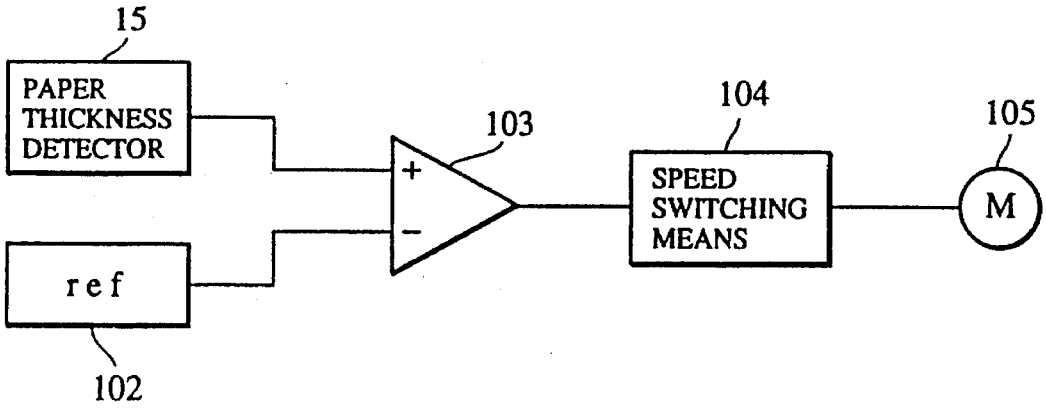
FIG. 11 is a block diagram illustrating a control circuit provided in an image forming apparatus in accordance with a further embodiment of the present invention.

FIG. 11 illustrates the configuration of the control circuit.

In FIG. 11, reference numeral 102 denotes a voltage generator (ref) outputting a voltage corresponding to the reference paper thickness; reference numeral 103, a comparator; reference numeral 104, a speed switching means for switching the speed of the film 11*a* of the fixing device 11 between a normal speed and a low speed; and reference numeral 105, a motor for driving the fixing device 11.

When the thickness of the recording material P which is detected by the paper thickness detector 15 is smaller than the predetermined thickness, the output from the comparator 103 becomes "L", and the speed switching means 104 outputs a control signal corresponding to output "L" to the driving motor 105 to drive the fixing device 11 at the normal speed.

On the other hand, when the thickness of the recording material P detected by the paper thickness detector 15 is larger than the predetermined thickness, the output from the comparator 103 becomes "H", and the speed switching means 104 switches the speed to the low speed side and outputs the control signal to the driving motor 105 to drive the fixing device 11 at a low speed.

Although, in this embodiment the speed is switched between the two stages, the speed may be switched between three or more stages in accordance with the thickness of the recording material.

As described above, in this embodiment, when the thickness of the recording material is larger than the predetermined thickness, the driving speed of the fixing device 11 is stepwisely switched to the low speed, thereby keeping the amount of the heat absorbed by the recording material per unit time from the heating member having a low heat capacity at a low value. This results in prevention of a decrease in the temperature of the heating member and achievement of stable fixing.

Figure 12:
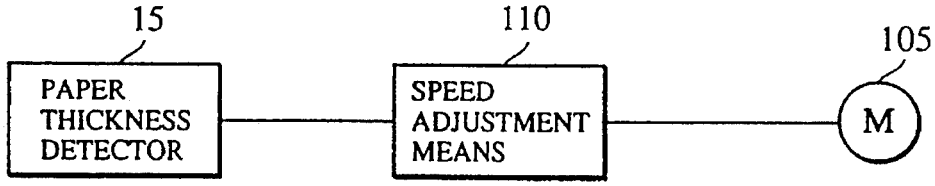
FIG. 12 is a block diagram illustrating a control circuit provided in an image forming apparatus in accordance with a still further embodiment of the present invention.

A still further embodiment of the present invention is described below with reference to FIGS. 12 and 13. Since the construction of the apparatus is similar to that shown in FIG. 10, only the different portions are described below. FIG. 12 is block diagram illustrating the configuration of the control circuit, and FIG. 13 is a graph illustrating a relation between the thickness of the recording material and the driving speed of the fixing device.

This embodiment is provided with speed adjustment means 110 for changing the speed of the fixing device driving motor 105 in accordance with the thickness of the recording material detected by the paper thickness detector 15, as shown in FIG. 12. Namely, the conveyance speed of the recording material is set in one-to-one correspondence to the thickness of the recording material, i.e., in a one-to-one relation therebetween.

Figure 13:
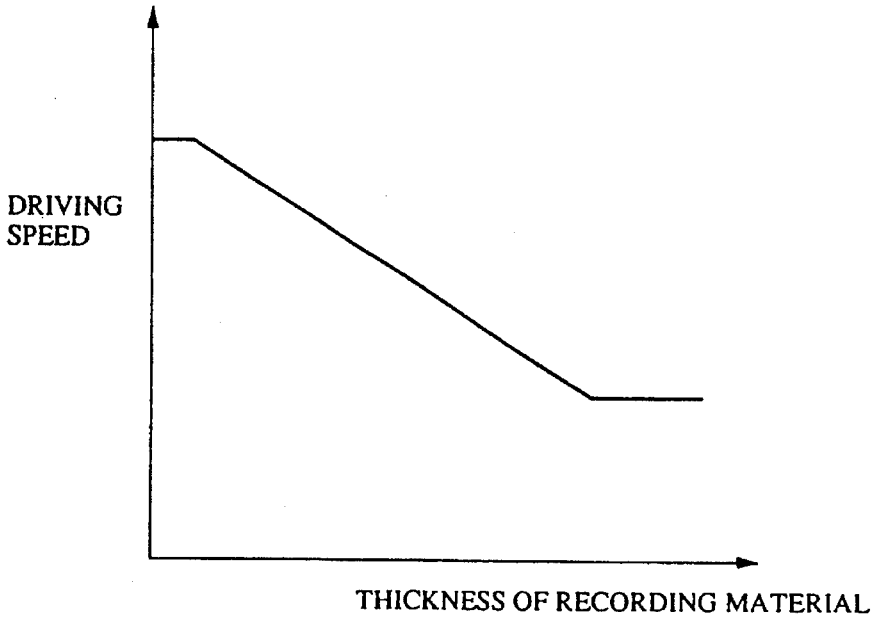
FIG. 13 is a graph illustrating a relation between the thickness of a recording material and the driving speed of a fixing device.

In this embodiment, since the driving speed of the fixing device 11 shown in FIG. 10 is controlled so that it gradually decreases with increases in the thickness of the recording material P detected by the paper thickness detector 15, as shown in FIG. 13, the amount of heat absorbed by the recording material P per unit time from the heating member having a low heat capacity provided in the fixing device 11, is kept to a low value. This prevents a decrease in the temperature of the heating member and provides for uniform fixing of the image, as in the abovedescribed embodiments. In addition, this embodiment does not cause useless speed down, thereby preventing deterioration in the function of the apparatus.

Figure 14:
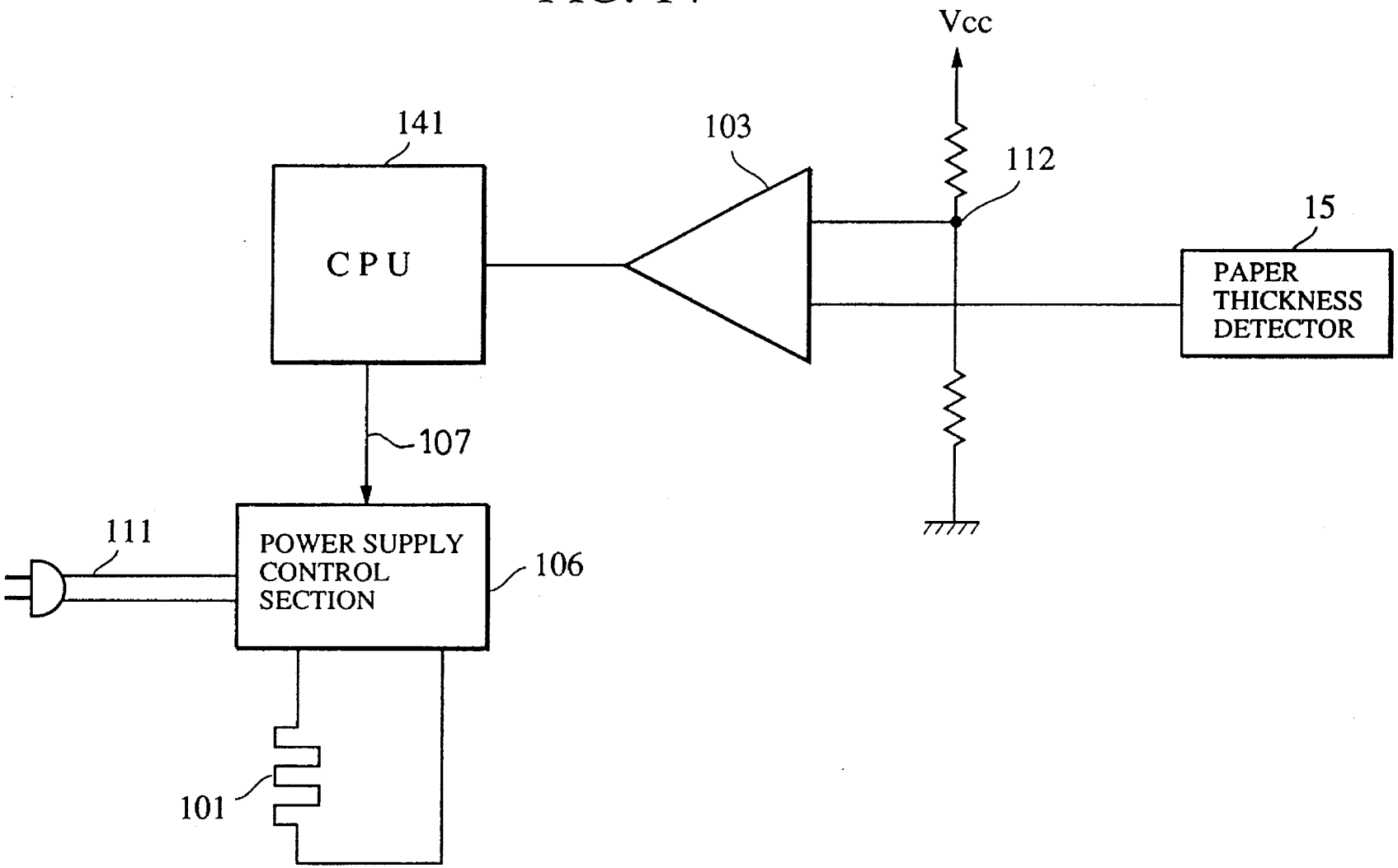
FIG. 14 is a block diagram illustrating a control circuit provided in an image forming apparatus in accordance with another embodiment of the present invention.

FIG. 14 is a block diagram illustrating the configuration of a control circuit provided in an image forming apparatus in accordance with another embodiment of the present invention. The basic construction of the image forming apparatus in accordance with this embodiment is similar to that shown in FIG. 10.

In FIG. 14, reference numeral 15 denotes a paper thickness detector for detecting the thickness of a recording material; reference numeral 101, a heating member of the fixing device; reference numeral 112, a voltage corresponding to the reference thickness of the recording material; reference numeral 103, a comparator; reference numeral 141, a CPU for setting the electric power supplied to the heating member 101 of the fixing device; reference numeral 111, an AC input section for supplying electric power to the heating member 101; reference numeral 106, a power supply control section for controlling the AC input of the AC input section 111 to control the electric power supplied to the heater of the heating member 101; and reference numeral 107, a signal for controlling the power supply control section 106.

When the thickness of the recording material which is detected by the paper thickness detector 15 is smaller than the reference thickness, the output from the comparator 103 becomes "L" and is input to the CPU 141, and the signal 107 for controlling the electric power supplied to the heating member 101 of the fixing device to a normal level is output from the CPU 141 to the power supply control section 106.

When the thickness of the recording material detected by the paper thickness detector 15 is larger than the reference thickness, the output from the comparator 103 becomes "H", and is input to the CPU 141. The CPU 141 then outputs, to the power supply control section 106, the control signal 107 for increasing the power supplied to the heating member 101 of the fixing device by stepwisely switching the set temperature of the heating member 101. The set temperature may be switched between three or more stages in accordance with the thickness of the recording material.

As described above, in this embodiment, when the thickness of the recording material is greater than the reference thickness, the electric power supplied to the heating member 101 of the fixing device is increased for compensating for the amount of the heat absorbed from the heating member 101 having a low heat capacity by a thick recording material. This results in the prevention of a decrease in the temperature of the heating member 101, and achievement of stable fixing.

Figure 15:
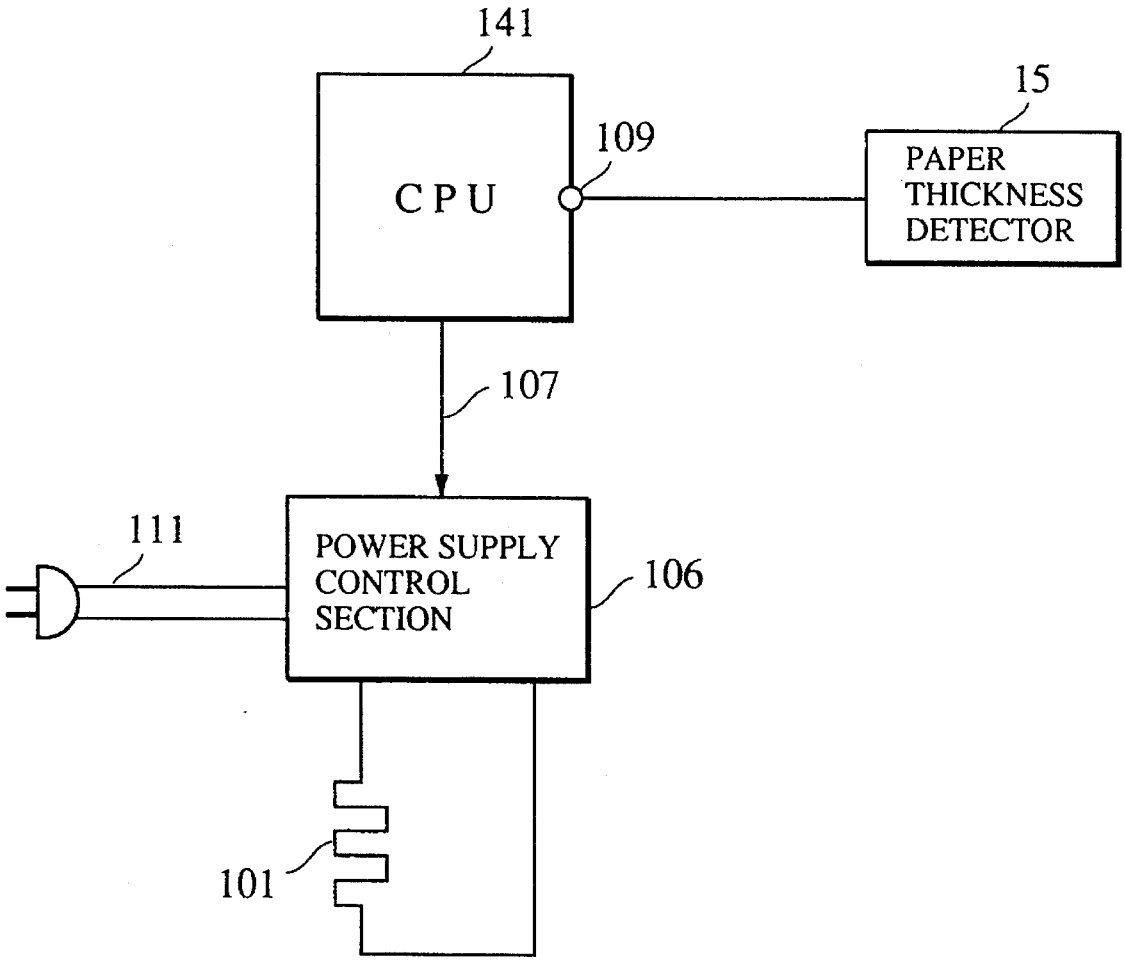
FIG. 15 is a block diagram illustrating a control circuit provided in an image forming apparatus in accordance with a further embodiment of the present invention.
Figure 16:
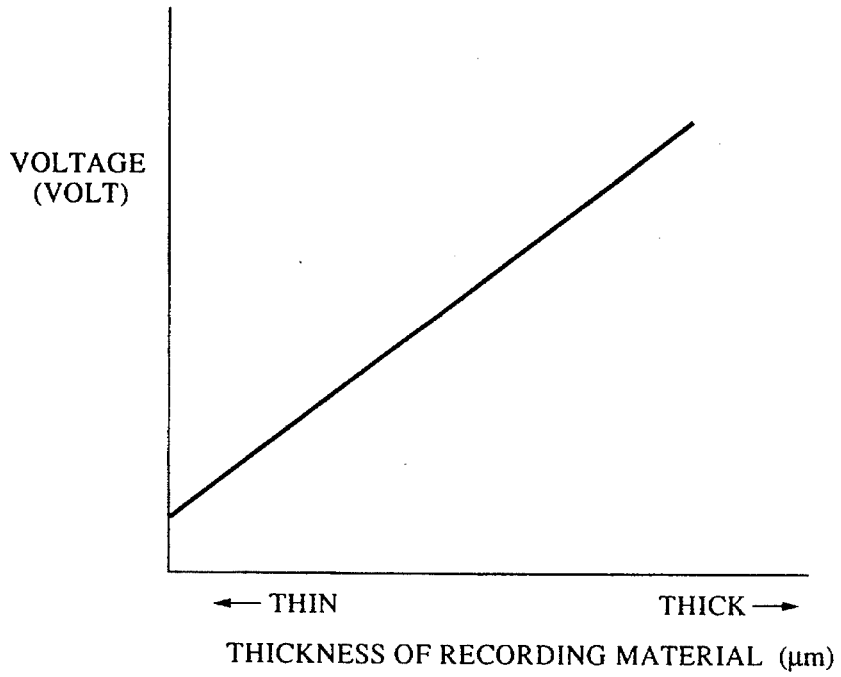
FIG. 16 is a graph illustrating a relation between the thickness of a recording material and the detected voltage.

A further embodiment of the present invention is described below with reference to FIGS. 15 to 17. Since the construction of the apparatus is the same as that shown in FIG. 10, only different portions are described below. FIG. 15 is a block diagram illustrating the configuration of a control circuit provided in the image forming apparatus in accordance with this embodiment. FIG. 16 is a graph illustrating the relation between the thickness of the recording material and the voltage output by the paper thickness detector, and FIG. 17 is a graph illustrating the relation between the thickness of the recording material and the set temperature of the heating member.

In the block diagram of FIG. 15, the same elements as those of the above embodiments are denoted by the same reference numerals, and are not described below.

Figure 17:
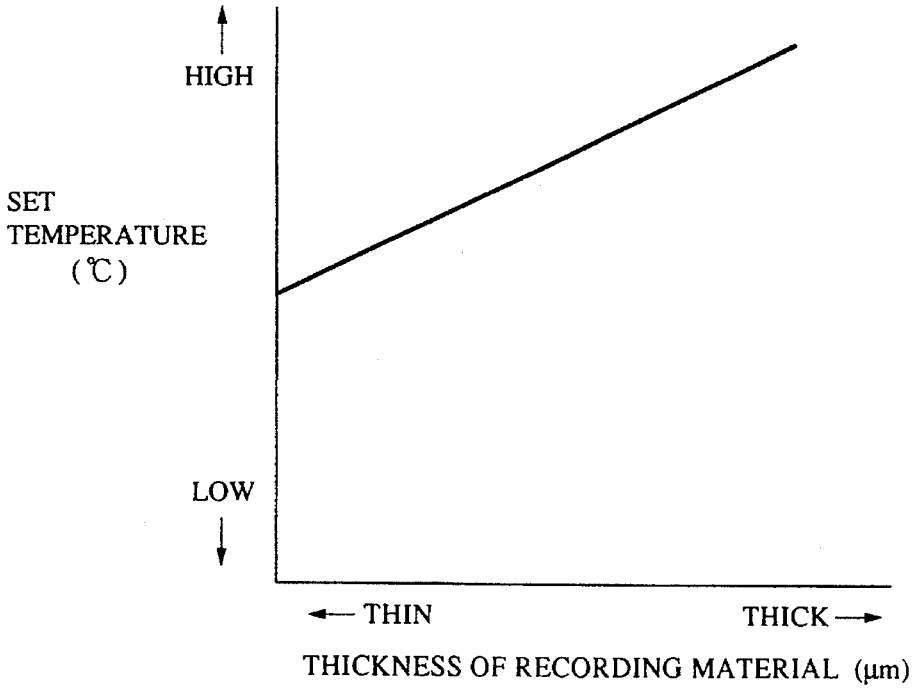
FIG. 17 is a graph illustrating a relation between the thickness of a recording material and the set temperature of a heating member.

In this embodiment, when the thickness voltage (the voltage which increases with increases in the thickness of the recording material) shown in FIG. 16, which is detected by the paper thickness detector 15, is input as A/D conversion input 109 to the CPU 141, the CPU 141 changes the set temperature of the heating member 101 in accordance with the thickness of the recording material (i.e, increases the set temperature with increases in the thickness of the recording material), as shown in FIG. 17, and outputs the control signal 107 to the power supply control section 106 to control the electric power supplied to the heating member 101 of the fixing device. Namely, the temperature is set in one-to-one correspondence to the thicknesses, i.e., the set temperature and the thickness have a one-to-one relation.

In this embodiment, since the electric power supplied to the heating member 101 is controlled so as to continuously increase with increases in the thickness of the recording material, the heating member 101 having a low heat capacity can compensate for the quantity of heat absorbed by the recording material, particularly, the thick recording material, thereby obtaining the same effects as those of the aforementioned embodiments. Further, since useless heating does not occur in this embodiment, the embodiment is more effective. Although, in the above embodiments, the fixing means is controlled, the development bias may also be controlled, as described above.

While the invention has been described with reference to the structures disclosed therein, it is not confined to the details set forth and the application is intended to cover such modifications or changes as may come within the purposes of the improvements of the scope of the following claims.

What is claimed is:

1. An image forming apparatus comprising:

image forming means for forming an image on a recording material;

an air capacitor comprising two opposing conductor plates spaced at a predetermined distance larger than the thickness of the recording material; and control means for controlling an image forming condition made by said image forming means on the basis of an electrostatic capacity when the recording material is inserted between the conductor plates.

2. An image forming apparatus according to claim 1, wherein said image forming means includes fixing means for fixing an unfixed image on said recording material while holding and conveying said recording material, and said control means controls the conveyance speed of the recording material conveyed by said fixing means.

3. An image forming apparatus according to claim 1, wherein said image forming means includes fixing means for heating and fixing an unfixed image, and said control means controls the set temperature of said fixing means.

4. An image forming apparatus according to claim 1, wherein said image forming means includes an image bearing member and development means for developing an electrostatic image formed on said image bearing member by applying a bias voltage thereto, and said control means controls the bias voltage of the development means.

5. An image forming apparatus according to claim 1, wherein said image forming means includes a film, a pressure roller in pressure contact with said film, and fixing means for fixing an unfixed image to the recording material at the pressure contact portion between said film and said pressure roller.

6. An image forming apparatus according to claim 1, wherein the electrostatic capacity when the recording material is inserted between the conductor plates varies in accordance with the difference in dielectric constants between air and the recording material.

* * * * *